US006412548B1

(12) United States Patent
Terashima et al.

(10) Patent No.: US 6,412,548 B1
(45) Date of Patent: Jul. 2, 2002

(54) WATER TUBE PROTECTIVE REFRACTORY STRUCTURE AND METHOD OF ASSEMBLING THE SAME

(75) Inventors: Yasuhiro Terashima; Yuji Nakagawa; Keita Inoue; Minoru Ike, all of Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/355,282

(22) PCT Filed: Oct. 26, 1998

(86) PCT No.: PCT/JP98/04832

§ 371 (c)(1),
(2), (4) Date: Oct. 27, 1999

(87) PCT Pub. No.: WO99/28674

PCT Pub. Date: Jun. 10, 1999

(30) Foreign Application Priority Data

Nov. 28, 1997 (JP) ..... 9-343849

(51) Int. Cl.[7] ..... F28F 19/00; F28F 7/00; F22B 37/10

(52) U.S. Cl. ..... 165/134.1; 165/81; 122/512

(58) Field of Search ..... 165/162, 81, 67, 165/134.1; 122/6 A, 510, 511, 512, DIG. 13; 110/325

(56) References Cited

U.S. PATENT DOCUMENTS

| | | | | | |
|---|---|---|---|---|---|
| 2,463,217 | A | * | 3/1949 | Tonneson | 52/509 |
| 3,828,735 | A | * | 8/1974 | Graham et al. | 122/6 A |
| 4,150,933 | A | * | 4/1979 | Yano et al. | 425/218 |
| 4,768,447 | A | * | 9/1988 | Roumeguere | 110/325 |
| 4,898,122 | A | * | 2/1990 | Black | 122/6 A |
| 4,966,100 | A | * | 10/1990 | Fournier et al. | 122/6 A |
| 5,243,801 | A | * | 9/1993 | Aiken et al. | 122/6 A |
| 5,800,775 | A | * | 9/1998 | Vihnicka et al. | 226/230 |
| 5,845,610 | A | * | 12/1998 | Hatta et al. | 122/510 |
| 5,884,695 | A | * | 3/1999 | Brownlee | 165/134.1 |
| 6,012,401 | A | * | 1/2000 | Orita et al. | 110/325 |

FOREIGN PATENT DOCUMENTS

| | | | |
|---|---|---|---|
| GB | 2102054 A | * | 1/1983 |
| JP | 58224224 A | * | 12/1983 |
| JP | 1106706 | * | 7/1989 |
| JP | 7-225016 | | 8/1995 |
| JP | 09184602 A | * | 7/1997 |

* cited by examiner

*Primary Examiner*—Ira S. Lazarus
*Assistant Examiner*—Tho Van Duong

(57) ABSTRACT

A heat-resistant assembly having a heat-resistant block conformed to the contours of boiler tubes and the surface of their connecting rib. The heat-resistant assembly has an arm which protrudes from the surface of the rib toward the heat-resistant block and which has a catch on the end. The block has an indentation in which the catch on the arm engages. The block can be hung on or removed from the tube assembly by means of the arms and indentations. The heat-resistant assembly is further distinguished by the fact that a space is created between the end of the arm and the indentation of the block. A fusible substance, which will melt when the temperature of the arm exceeds a given value, is placed in the space. The heat-resistant sleeve is adhered to engage the arm. This arrangement makes it possible to manufacture the heat-resistant block using press molding.

12 Claims, 11 Drawing Sheets

WATER TUBE PROTECTIVE REFRACTORY STRUCTURE AND METHOD OF ASSEMBLING THE SAME

TECHNICAL FIELD

This invention concerns a heat-resistant assembly for the water tubes of a heat-exchanger in a boiler to protect them from an atmosphere of super-heated gases, as well as a method of assembling this device.

TECHNICAL BACKGROUND

The water tubes which conduct heat in waste-heat boilers are protected from the heat conducted by the combustion gases and from their corrosive atmosphere by a heat-resistant block.

FIGS. 19 through 21 show several examples of heat-resistant assemblies for the water tubes of a waste-heat boiler taken from the prior art.

The design shown in FIG. 19 was proposed in Japanese Patent Publication (Kokai) 9-184602. In this drawing, 11 are boiler tubes and 13 are flat ribs to lend strength to tubes 11 by connecting them in either a horizontal or a vertical array. 26 are heat-resistant blocks of a ceramic material which are placed so as to protect the tubes 11 from combustion gases 50. The tubes 11 are protected from the heat of the combustion exhaust gases and their corrosive atmosphere 50 by these heat-resistant blocks 26. 23*a* is a bolt for affixing the heat-resistant block 26 onto one of the flat ribs 13. The bolt 23*a* extends from the flat rib 13 through heat-resistant block 26. When nut 23*b* is tightened on bolt 23*a*, the heat-resistant block 26 is fastened to tubes 11 and ribs 13.

20 is mortar which fills the spaces between heat-resistant block 26 and ribs 13 or tubes 11. 27 is a cap which is placed on top of nut 23*b* in order to protect the top of the bolt 23*a*, the portion of the bolt on which nut 23*b* engages, from combustion gases 50.

FIGS. 20 and 21 show a design proposed in Japanese Patent Publication (Kokai) 9-236203. FIG. 20 is a cross section taken orthogonally with respect to the axes of the tubes. FIG. 21 is a cross section taken along line A—A in FIG. 20. In FIGS. 20 and 21, 11 are the tubes; 13 are the flat ribs which lend strength to the tubes 11 by connecting them; 36 is the heat-resistant block which protects the tubes 11 and ribs 13 from combustion gases 50; and 20 is the mortar which fills the spaces between the heat-resistant block 36 and ribs 13 or tubes 11.

38 is an arm which fixes the block 36 to its rib 13. Arm 38 protrudes from the appropriate portion of the rib 13. When indented portion 37 engages with the arm 38, the heat-resistant block 36 is securely attached to tubes 11 and ribs 13.

Although we do not include drawings, designs for these sorts of heat-resistant assemblies for protecting boiler tubes are proposed in Japanese Utility Patent Publication (Kokai) 1-106706 (Title of invention: Water-cooled Wall) and Japanese Patent Publication (Kokai) 7-225016 (Title of invention: Configuration of Incinerator Walls and Heat-resistant Bricks).

The design proposed in Utility Patent Publication 1106706 features supportive fittings which slant upward on the ribs (or fins) between the tubes and are fixed so that they protrude at specified intervals along the length of the tubes. Indentations are provided on the heat-resistant blocks into which the fittings engage. The spaces between the fittings and indentations are filled with mortar.

In the design proposed in Patent Publication 7-225016, the heat-resistant block (in this case, heat-resistant brick) consists of a number of mantles which have an arc-shaped cross section so that they conform to the contour of the tubes and connective portions which link the mantles. A number of projections are provided on the heat-resistant block at specified intervals along the axes of the tubes so as to maintain the necessary space between the block and the exterior surfaces of the tubes which is to be filled with mortar. Mounting holes are provided in the heat-resistant block into which fittings can be inserted to mount the tubes to the connective portions.

However, the designs described above have the following failings.

In the design proposed in the Patent Publication 9184602, which is shown in FIG. 19, bolt 23*a* becomes hot when the boiler is operating and undergoes thermal expansion, causing cap 27 to jut out toward combustion gases 50 and separate from the bolt. This results in both the bolt 23*a* and the nut 23b being exposed to combustion gases 50, which are likely to corrode them. If this corrosion continues over time, heat resistant block 26 will be damaged, or it will separate from the tubes.

And because the heat-resistant block 26 is fastened to boiler tubes 11 and rib 13 by bolt 23*a*, which is fixed to rib 13 and immobilized, it is constrained when the bolt 23*a* is tightened. In addition, the thermal expansion differential between tubes 11 and block 26 causes thermal distortion. When this constraint or distortion occurs, the resulting thermal stress and that caused by the temperature differential between the interior and exterior of block 26 will damage the block.

The design proposed in Patent Publication 9-236203, which is pictured in FIGS. 20 and 21, has the potential to solve the problems of the prior art shown in FIG. 19. However, in this device heat-resistant block 36 is supported solely by arm 38, which protrudes obliquely upward from rib 13 and is forced into indentation 37 in the block. This makes it difficult to securely fasten block 36 to tubes 11 and rib 13, and the block 36 has a tendency to slip off the tubes.

With the design proposed in Utility Patent publication 1-106706, just as with that in Publication 9-236203, the heat-resistant block is supported on the tubes solely by a fitting which protrudes obliquely upward from the rib and is engaged in an indentation in the block. This makes it difficult to securely fasten the block to the tubes, and the block has a tendency to become detached.

In the design proposed in Patent Publication 7-225016, just as in that proposed in Publication 9-184602, the end of the fitting which mounts the tubes to the connective portion of the block is exposed to the combustion gases, so it corrodes. If this corrosion is allowed to continue, the block will be damaged or detached from the tubes.

With the prior art designs discussed above, for example that of Patent Publication 9-236203, shown in FIGS. 20 and 21, the heat-resistant block 36 must have an obliquely slanted indentation 37 into which arm 38 of tube 11 can engage. If the angle of inclination of this indentation becomes too large, it will be impossible to remove the block from the mold, and it will not be possible to form the block 36 using a press. Also, in order to attach the block securely, the angle of inclination must be very large. However, a large angle requires that a special mold be used, thereby increasing the production time and the cost.

Such a block 36 is manufactured by pouring the raw material into a metal mold. A molded block is inferior to a pressed block with respect to both strength and durability.

Furthermore, in prior art designs, for example in the design in Patent Publication 9-236203, the space between metal arm 38, which is fixed to tubes 11, and heat-resistant block 36 is filled with mortar to attach the arm 38 to block 36.

The temperature of the area between the arm 38 and block 36 which is filled with mortar rises to 250° C. to 500° C. The rate of thermal expansion differs widely between metal arm 38 and mortar 20. In prior art devices, then, the differential in thermal expansion between the arm 38 and mortar 20 would damage the mortar, which would have an adverse effect on the durability of the heat-resistant assembly.

With the prior art designs discussed above, the mortar for fastening the tube assembly to the heat-resistant block was introduced into the space between the two. When it approached the required thickness, the worker would use a hand tool such as a trowel to finish filling the mortar to the required thickness according to his own intuition. With prior art designs, then, the final thickness of the mortar would vary with the worker. This caused the durability of different blocks to vary, which sometimes resulted in damage to the blocks.

DISCLOSURE OF THE INVENTION

This invention is an attempt to solve such problems of the prior art as were discussed above.

The first objective of this invention is to provide a design by which the heat-resistant block can be securely attached to the tube assembly consisting of the tubes and the connecting ribs, and which will prevent the block from being damaged or separating from the tubes.

The second objective of this invention is to simplify the process by which the heat-resistant block is assembled or disassembled by making it possible to mount or remove a segment of the block from any portion of the tube assembly.

The third objective of this invention is to prevent the block or its mounting hardware from being damaged by thermal stress or corroded by high temperatures so as to improve the durability of the heat-resistant assembly.

The fourth objective of this invention is to make it possible to manufacture the heat-resistant block using press molding so as to achieve a block with great strength.

The fifth objective of this invention is to prevent the mortar which fills the space between the block and the tube assembly from being damaged by the differential thermal expansion of the mortar and the tube assembly so as to improve the durability of the heat-resistant assembly.

The sixth objective of this invention is to simplify the process of filling the mortar, reduce the number of processes needed to mount the heat-resistant assembly, and make it possible to fill the space between the tube assembly and the block with a uniform thickness of mortar so as to improve the strength of the areas where the mortar is introduced.

To achieve the objectives outlined above, the present invention has been designed so as to comprise the means disclosed in certain preferred embodiments.

In an embodiment, a heat-resistant assembly for protecting boiler tubes is disclosed. This heat-resistant assembly has a heat-resistant block conformed to the contours of the boiler tubes and the surface of their connecting ribs. The boiler tubes and the ribs constitute a tube assembly, and the heat-resistant assembly is placed between the tube assembly and the combustion gases to protect the tube assembly from the combustion gases which are the products of combustion. This heat-resistant assembly is distinguished by the following. It has arms which protrude from the surface of the ribs toward the heat-resistant block and which have catches on their ends. The block has indentations into which the catches on the arms engage. The block can be attached to or removed from the tube assembly by means of the arms and indentations.

In an embodiment, the heat-resistant assembly is further distinguished by the fact that the catches on the arms are formed by bending the ends of the arms which protrude toward the block so that they are angled vertically parallel to the tubes.

In another embodiment, the heat-resistant assembly is further distinguished by the fact that the cross section of the arm will have greater expansion from the tube assembly side towards the heat-resistant block side.

To be more specific, a cross section which goes through the catch on the arm nearer the block will have a greater area than one nearer the tube assembly because a projection is provided on the end of the arm nearer the block. A corresponding indentation is provided on the block. When the projection engages in this indentation, the block is locked to the arm.

In an embodiment, the heat-resistant assembly is further distinguished by the fact that projections are provided on both the upper and lower ends of the heat-resistant block. One of these projections is on the side of the block which faces the combustion gases; the other is on the side which faces the tubes. When the blocks are stacked vertically, the projection on the gas side of one block will face the projection on the tube side of the next block.

In an embodiment, the heat-resistant assembly is further distinguished by the fact that the catches on the arms are formed by bending the ends of the arms which project toward the block so that they are angled vertically parallel to the tubes. The force of gravity will cause the block to descend so that the vertical catches can engage in its indentations. In addition, one projection is provided on the upper end of the block on the side facing the combustion gases and a second projection is provided on the lower end of the block on the side facing the tubes.

The heat-resistant blocks are interlockingly fastened or attached to the tube assembly by arms on its ribs which are made to engage in indentations in the heat-resistant block taking advantage of the gravitational force exerted by the weight of the block. There is no need for bolts or nuts as were used in the prior art, which may protrude into the chamber filled with combustion gases. Thus there is no possibility of high-temperature corrosion.

Because the arms have vertical end portions which are parallel to the tubes, the blocks can be fastened to the tube assembly using the weight of the block so that they can be freely removed or replaced even if the tube assembly consisting of the tubes and their connecting ribs is located at the top end where no upper space is left.

Since there is no need for locking mechanisms such as the nuts and bolts employed in prior art devices, and the means used to fasten the blocks to the tubes allow them to be removed or replaced, there is no possibility of thermal constraint between the tubes and the block. As a result, the block can be made much thinner. The temperature differential between the interior and exterior of the block will be much smaller, the temperature of the block will not spike, and the block will experience less thermal stress.

Providing projections on both the upper and lower ends of each block segment, with the upper projection on the side that faces the combustion gases and the lower projection on the side that faces the tubes, has the effect of modularizing the block, so that for example a single segment (or set of segments) could be removed. This design makes it possible to repair portions of the block and simplifies maintenance.

Placing projections on the upper and lower ends of each heat-resistant block segment, one on the side of the block facing the combustion gases and the other on the side facing the tubes, ensures that spaces will be provided for thermal expansion of the block and prevents the extremely hot corrosive gases in the combustion gas chamber from coming in contact with either the tubes or the interlocking mechanism consisting of the arm and indentation.

In an embodiment, the heat-resistant assembly is further distinguished by the fact that a space is provided at least between the end of the arm and the indentation of the block. In the space is placed a fusible substance which will melt when the temperature of the arm exceeds a given value.

With this invention, if the metal arm which is a component of the tube assembly exceeds a specified temperature, say 250° C., while the boiler is operating, the fusible substance placed in the space will melt, thereby creating a new expansion space.

The space, then, accommodates the expansion which the arm undergoes as its temperature rises. In other words, it is a gap which allows for thermal expansion of the arm. This prevents the mortar from being damaged by the differential between the rates of thermal expansion of the arm and the mortar.

A suitable choice for the fusible substance might be rubber tape. Alternatively, the space could be filled with paint.

In an embodiment, a heat-resistant assembly for protecting boiler tubes is disclosed. This heat-resistant assembly has a heat-resistant block conformed to the contours of the boiler tubes and the surface of their connecting ribs. The boiler tubes and the ribs constitute a tube assembly, and the heat-resistant assembly is placed between the tube assembly and the combustion gases to protect the tube assembly from the combustion gases which are products of combustion. This heat-resistant assembly is distinguished by the following. An arm with a catch on its end projects from the surface of the rib toward the heat-resistant block. An indentation is formed in the block facing the rib. A locking means such as a sleeve, which is formed by a press to ensure that it will have sufficient strength, is adhered into the indentation. The heat-resistant block is fastened to the arm by the locking means.

In an embodiment, the heat-resistant assembly is further distinguished by the fact that the locking means is made of a heat-resistant substance of the same silica family as the heat-resistant block, and the adhesive agent is a high-temperature adhesive which can tolerate the heat of the locking means.

To mount the heat-resistant block to the arm of the tube assembly, a heat-resistant sleeve is first inserted into the indentation in the block opposite the rib. The outside surface of the sleeve is coated with a high-temperature adhesive, and the sleeve is attached (i.e., cemented) to the heat-resistant block. When the arm engages in the heat-resistant sleeve, the block is fixed to the tube assembly in the same fashion that a picture is hung on a wall.

With this invention, the heat-resistant block itself has no interlocking mechanism by which it is directly attached to the arm, but only an indentation opposite the rib. This indentation can be formed when the block is pressed, so it is possible to release the press die from the pressed block, and thus possible to manufacture the entire block using a press process.

A heat-resistant block can thus be achieved which is extremely strong because it is formed by a press.

The use in the locking means of a heat-resistant sleeve composed of silicon carbide vastly increases the strength of the mount.

Since the heat-resistant block is also composed of a material in the silica family such as alumina, silica or silicon carbide, it is made of the same sort of substance as the sleeve. The rates of thermal expansion of the block and the sleeve will be similar, and the block will not warp.

The adhesive which is used is one whose adhesive strength is not affected at temperatures in excess of 250° C. such as phosphoric acid mortar or Allonceramic (trade name). Thus there will be no loss of adhesion at high temperatures.

In an embodiment, the fastening method for fastening a heat-resistant assembly for protecting boiler tubes is disclosed. This heat-resistant assembly has a heat-resistant block conformed to the contours of the boiler tubes and the surface of their connecting ribs. The boiler tubes and the ribs constitute a tube assembly, and the heat-resistant assembly is placed between the tube assembly and the combustion gases to protect the tube assembly from the combustion gases which are the products of combustion. Mortar is used to fasten the heat-resistant blocks on the tube assembly. This method of fastening the heat-resistant assembly on the tube assembly is distinguished by the following. When the mortar is provided onto the depressed portions of the exterior surface of the tube assembly, the application process is divided into two steps: applying the mortar to the tube assembly, and applying the mortar to the block. Once the mortar has been applied to specified portions of the block and tube assembly, the two surfaces are cemented together through the adhesive strength of the mortar. In this way the tube assembly and heat-resistant block are attached to each other by the mortar.

The mortar is applied uniformly to the exterior surface of the tube assembly, including the depressed portions. In addition, the application process is divided into two steps: applying mortar to the tube assembly and applying mortar to the block. Since the mortar is applied to exposed spaces, no expertise is required. Also, because the spaces are exposed, the mortar can be applied to the specified thickness using a gauge such as a scraper.

The mortar is applied to the depressed portions of both the tube assembly and the block. The protruding portions (the opposed straight line along the tube assembly and straight flat portion of the block facing the ribs) can be used as guide surfaces in the scraping operation.

In another embodiment of this application, a fastening method for fastening a heat-resistant assembly for protecting boiler tubes is disclosed. This heat-resistant assembly has: a tube assembly having a number of tubes and the ribs which connect the tubes; a heat-resistant block conforming to the contour of the exterior surfaces of the tubes and ribs; interlocking mechanisms projecting from the surfaces of the ribs toward the block; and indentations on the surface of the block into which the interlocking mechanisms engage. This fastening method is distinguished by the fact that it entails the following processes.

It has a first process to control the thickness of the mortar, in which the excess mortar, which has been applied to the ribs connecting the contiguous tubes, is removed with a scraper using the exterior surface of the tubes as a guide;

In an embodiment, the fastening method for fastening a heat-resistant assembly is further distinguished by the fact that the portions where the mortar is to be applied to the tube assembly and the heat-resistant block are the indentations between contiguous tubes on the tube assembly, and the indentations on the curved interior surface of the block facing the exterior of the tube assembly on the heat-resistant block. a second process to control the thickness of the mortar, in which the excess mortar, which has been applied between the curved indentations on the block opposite the exterior surface of the tubes, is removed with a scraper using the flat straight surface of the block which faces the ribs as a guide; and a third process for cementing, in which the indentations on the block which have been filled with mortar in specified locations are brought in contact with the interlocking mechanisms on the tube assembly, so that the mortar causes the two surfaces to adhere to each other. Through these processes, the tube assembly and the block are cemented to each other by means of mortar.

In another embodiment, the excess mortar, which has been applied to the indentations between the tubes, is removed from the curved inner surfaces with a curved scraper whose shape conforms to the outer surface of the tube, and the excess mortar, which has been applied between the outside of the tube and the curved inner surface of the block opposite the tube, is removed with a scraper using the flat straight surface of the block opposite the rib as a guide. Not only the excess mortar on both the block and the tube assembly, but also that on the curved inner surfaces, is removed by a scraper with two concavities in its working edge. The operation of scraping off the excess mortar is made much easier, and fewer processes are required to construct a heat-resistant assembly for protecting boiler tubes.

Because the exterior surface of the tube and the flat straight part of the heat-resistant block are used as guides for the scraping operation, the mortar can be finished to a precise thickness.

A BRIEF EXPLANATION OF THE DRAWINGS

FIG. 1 shows the configuration of a heat-resistant assembly according to this invention, which is used to protect the boiler tubes in a waste-heat boiler. This is a first preferred embodiment of the invention, which corresponds to claims 1 through 6 of this application. The drawing is a cross section of the heat-resistant assembly for protecting the tubes in the combustor of the boiler, taken perpendicular to the axes of the tubes.

FIG. 2 is a cross section taken along line B—B in FIG. 1.

FIG. 3 shows the configuration of a heat-resistant assembly according to this invention, which is used to protect the boiler tubes in a waste-heat boiler. This is a second preferred embodiment of the invention, which corresponds to claims 1 through 6 of this application. The drawing is a cross section corresponding to FIG. 1.

Figure 13:
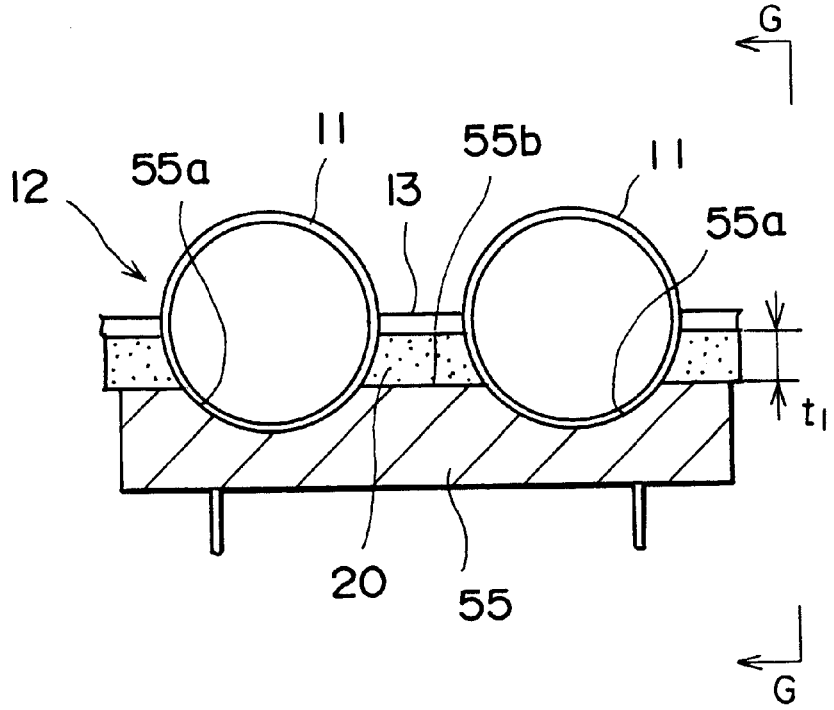

FIG. 13 shows the essential aspects of the method of constructing a heat-resistant assembly according to this invention for protecting the tubes in a waste-heat boiler. More specifically, it shows the essential aspects of removing the excess mortar used as an adhesive, which corresponds to the process of claim 9 of this application. The arrows indicate the direction perpendicular to the axes of the tubes.

Figure 14:
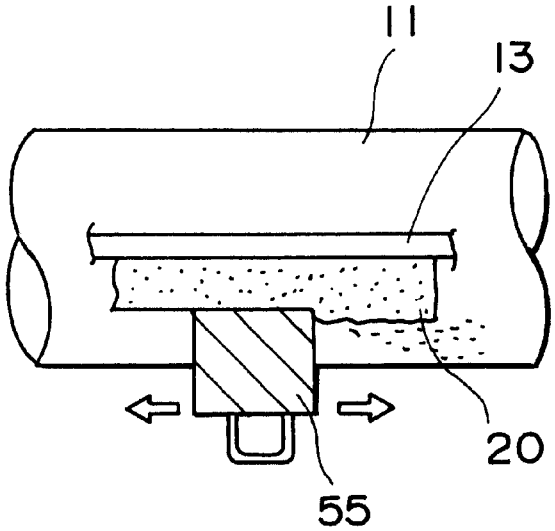

FIG. 14 is a view looking in the direction indicated by arrows G—G in FIG. 13.

Figure 15:
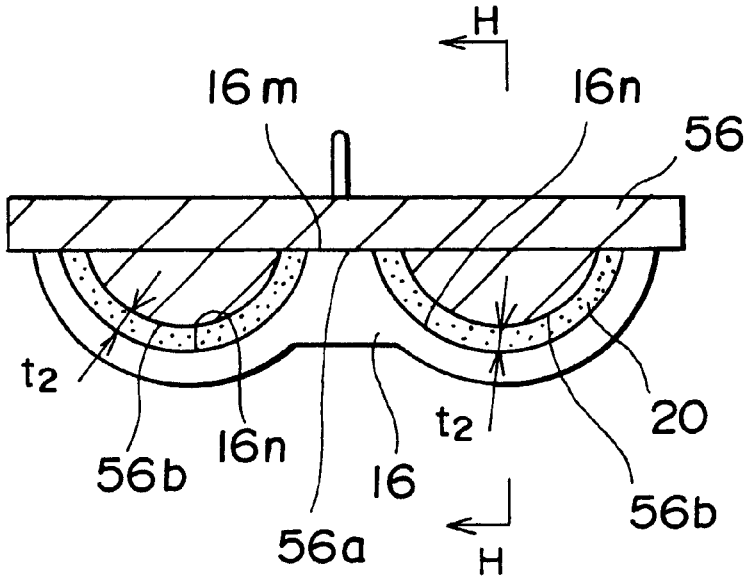

FIG. 15 shows a preferred embodiment corresponding to claims 11 through 12 of this application. It shows the same view as FIG. 13.

Figure 16:
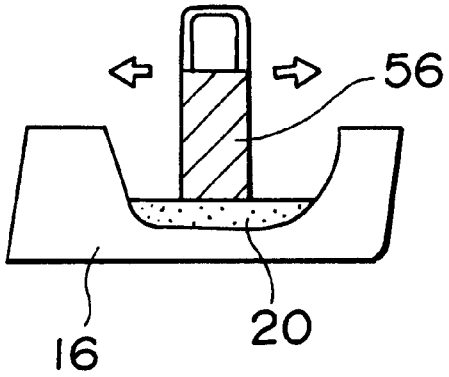

FIG. 16 is a view looking in the direction indicated by arrows H—H in FIG. 15.

Figure 17:
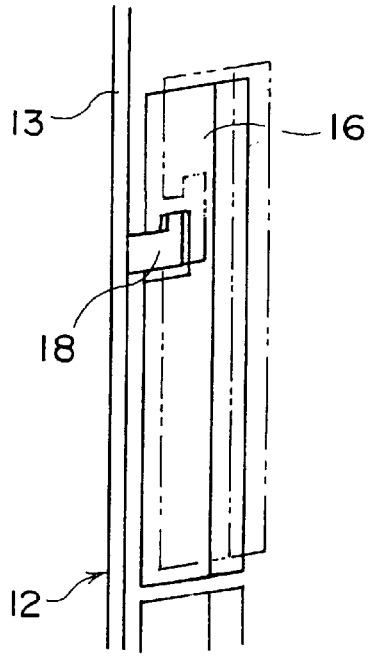

FIG. 17 is a perspective drawing which illustrates the essential aspects of the method of building a heat-resistant assembly which corresponds to claims 10 through 12 of this application.

Figure 18:
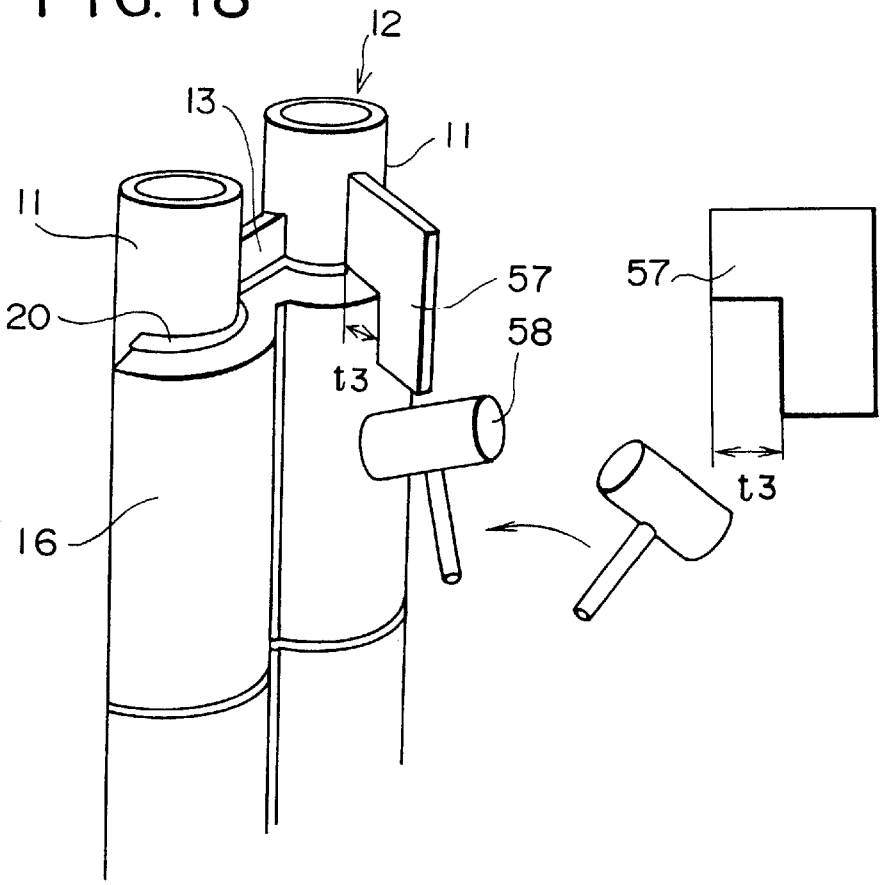

FIG. 18 is a perspective drawing which illustrates the essential aspects of the finishing work in the preferred embodiment of the method of building a heat-resistant assembly which corresponds to claims 10 through 12 of this application.

Figure 19:
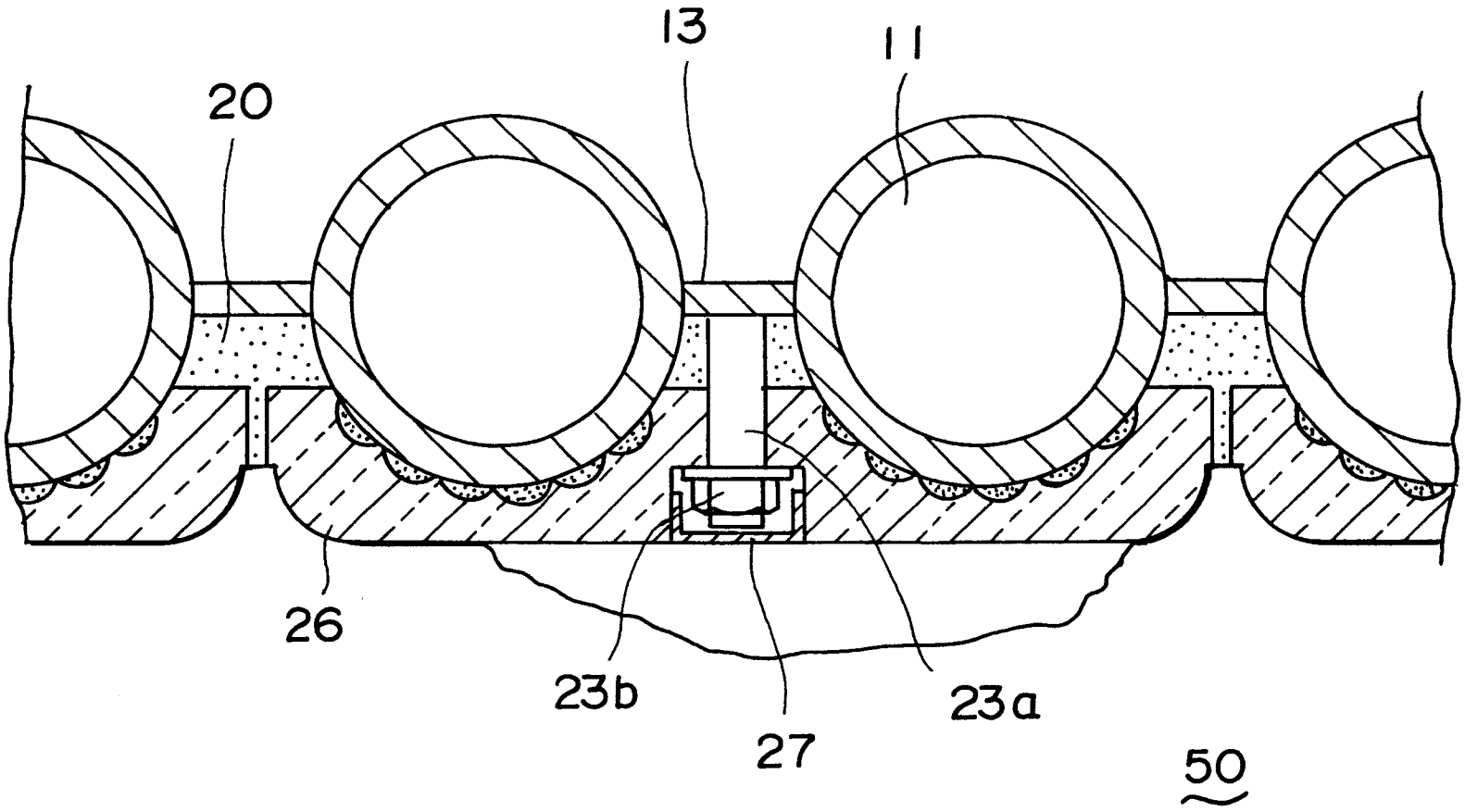
FIG. 19 PRIOR ART

FIG. 19 is a cross section taken perpendicular to the axes of the tubes which shows an example of the prior art.

Figure 20:
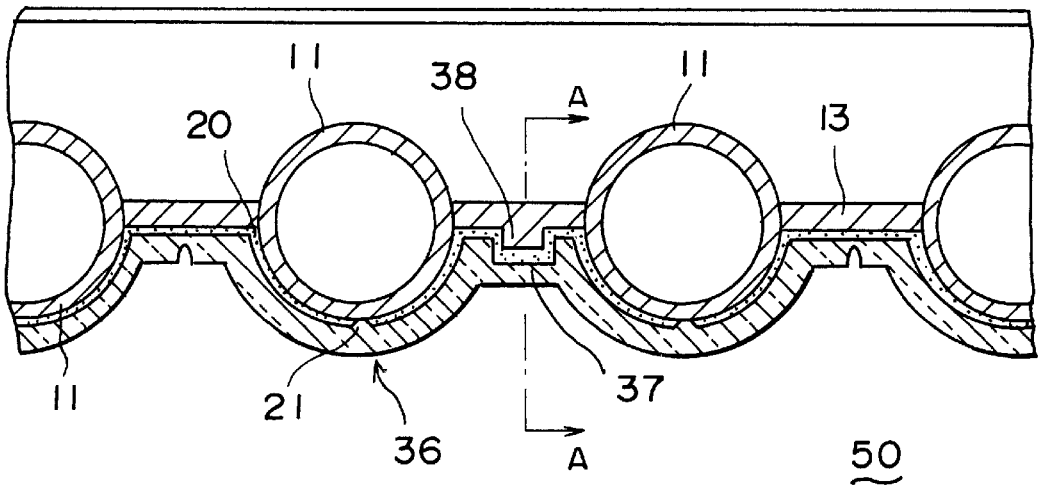
FIG. 20 PRIOR ART

FIG. 20 is a cross section taken perpendicular to the axes of the tubes which shows a second example of the prior art.

Figure 21:
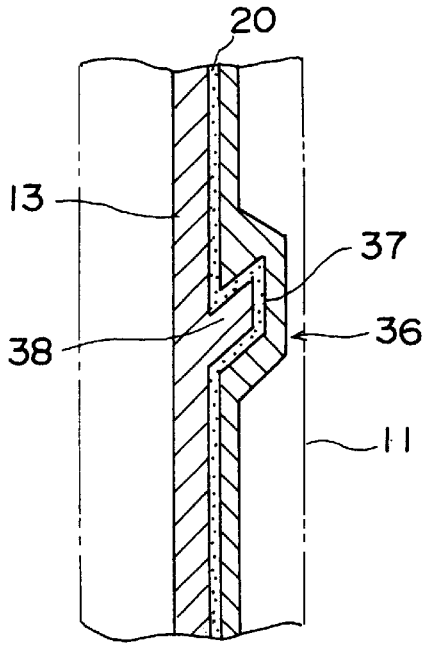
FIG. 21 PRIOR ART

FIG. 21 is a cross section taken along line A—A in FIG. 20.

PREFERRED EMBODIMENTS OF THE INVENTION

In the following section a detailed explanation of several preferred embodiments of this invention will be given with reference to the drawings. To the extent that the dimensions, material, shape or relative position of the structural components which are mentioned in these examples is not specifically disclosed, the invention is not limited only to the examples given, which are meant merely for the purpose of illustration.

Figure 1:
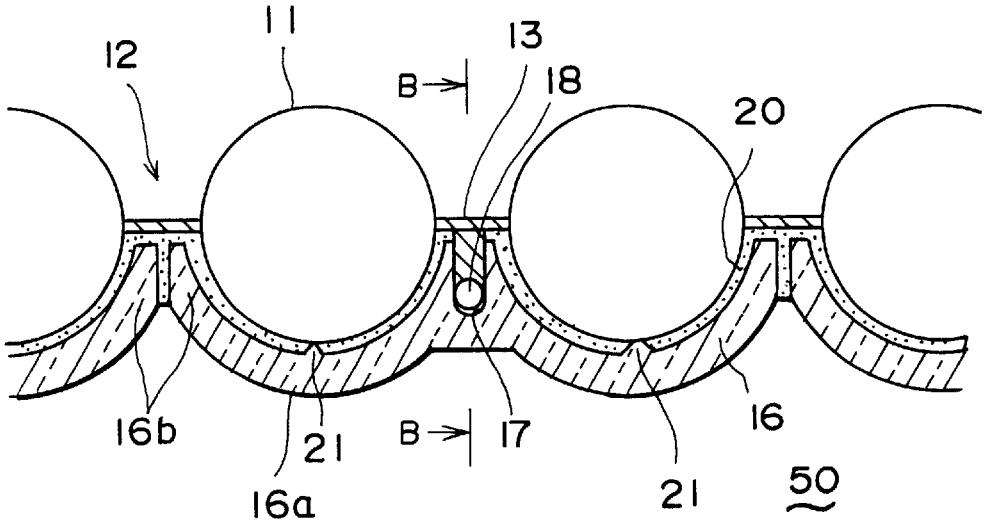
Figure 2:
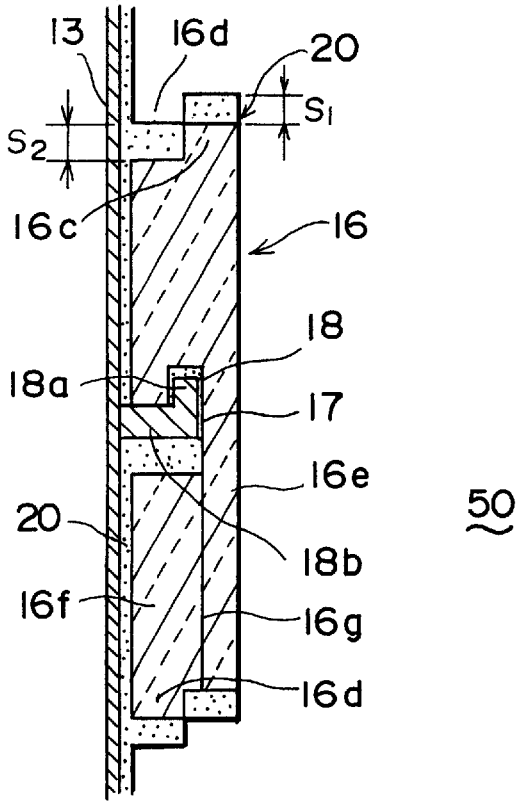

FIGS. 1 and 2 show a heat-resistant assembly for protecting the boiler tubes in a waste-heat boiler which is a first preferred embodiment of this invention. In these figures, 12 is the tube assembly, comprising multiple rows of tubes 11 and flat ribs 13, which connect adjacent tubes 11 in either a horizontal or a vertical array.

16 is the heat-resistant block. It covers the entire surface of the tube assembly 12 which faces combustion gases 50. The heat-resistant block 16 is produced by forming in a metal mold a heat-resistant material such as silicon carbide, which has relatively high thermal conductivity and good heat resistance. This block completely shields the side of the boiler tubes 11 and flat ribs 13 which faces combustion gases 50.

Arm 18 projects from the flat rib 13 at a given pitch along the longitudinal (i.e., axial) direction of tubes 11 toward the heat-resistant block 16.

As can be seen in FIG. 2, the arm 18 consists of projection 18*b*, which extends from the rib 13 at a right angle with respect to the surface of the rib, and vertical portion 18*a*, which is bent at a 90° angle from the projection 18*b* so that it extends upward, parallel to rib 13. The block 16 has as many indentations 17 as there are arms 18.

When the vertical portion 18*a* of the arm 18 engages in the indentation 17 using the weight of the heat-resistant block 16 and the adhesive strength of mortar 20, the block is mounted in the same fashion that a picture is hung on a wall.

As can be seen in FIG. 1, the arm 18 and the opposite indentation 17 preferably should be placed between two adjacent tubes 11 so as to create a single shielded entity from each two rows of tubes. However, it would also be possible to combine three or more rows in this fashion.

The space between the heat-resistant block 16 and the tube assembly 12 is filled with mortar 20. In the center of the inner periphery of the portion 16*a* of the block which shields a given tube is a mountain-shaped protrusion 21. A portion of the outer periphery of tube 11 comes in contact with the very top of the protrusion to assure that tube 11 and block 16 are positioned correctly.

A gap filled with mortar 20 is provided between the ends of each two adjacent blocks 16. This gap serves to accommodate the thermal expansion of block 16 and thus mitigate thermal stress.

As was mentioned earlier, the heat-resistant block 16 is divided horizontally into units shielding two or more tubes 11. As can be seen in FIG. 2, its perpendicular dimension is also divided into an appropriate number of vertical units by the blocks 16. At the top and bottom of each block 16 are projection 16*c* on the side which faces combustion gases 50, and projection 16d on the side which faces tubes 11. The upper projection of one block nearly meets the lower projection of the next, and the gaps on both sides are filled with mortar 20.

As can be seen in FIG. 2, each unit of the heat-resistant blocks 16 consists of a segment 16*e*, which runs the entire length of the block on the side which faces combustion gases 50, and a segment 16*f*, which faces tube assembly 12 below the indentation 17. Segments 16*e* and 16*f* are cemented together at 16*g*.

No unit of the heat-resistant blocks 16 will be affected by an adjacent unit or displaced by it. Vertical gaps $S_1$. and $S_2$ above the upper projection 16*c* of one block and below the lower projection 16*d* of the next are provided so that each unit can be installed or removed independently.

To mount a heat-resistant assembly configured in this way, the indentation 17 in the block 16 is hung from above, using the weight of the block, on the arm 18 which projects from the rib 13, and it is secured when mortar 20 is introduced into the gaps. Thus this embodiment does not require a nut and bolt as does the prior art example shown in FIG. 19, so it is not subject to the high-temperature corrosion of these components.

To remove a unit of heat-resistant block 16, the operations described above are reversed. Mortar 20 is removed and block 16 is lifted up, releasing vertical projection 18a of arm 18 from indentation 17. The block 16 can then be pulled out into the combustion gas chamber.

Thus even if tube assembly 12 is covered, heat-resistant block 16 can be fastened to it using its own weight in such a way that it can be removed and reinstalled.

This embodiment, then, has no portions which will be constricted by a nut and bolt, as was true of prior art designs. Because each unit of heat-resistant block 16 uses an interlocking mechanism which allows it to be installed or removed independently, there is no thermal constraint between tube assembly 12 and block 16. The block can be made thinner, so the temperature differential between its interior and exterior surfaces will be smaller. Temperature spiking can be avoided, thus reducing the thermal stress experienced by the block 16.

Providing projections on both the upper and lower ends of each block segment, with the upper projection 16*c* on the side that faces the combustion gases and the lower projection 16*d* on the side that faces the tubes, has the effect of modularizing the block, so that a single segment can be removed. This design makes it easier to repair a portion of the block.

The fact that upper and lower projections 16*c* and 16*d* of the block 16 each extend toward the adjacent segment overlapping each other ensures that spaces are available to be used as gaps $S_1$, and $S_2$ to accommodate the thermal expansion of the block 16. In addition, these projections prevent the corrosive high-temperature gases in combustion gas chamber 50 from having access to tube assembly 12 or its interlocking mechanism (arm 18 or the like).

Figure 3:
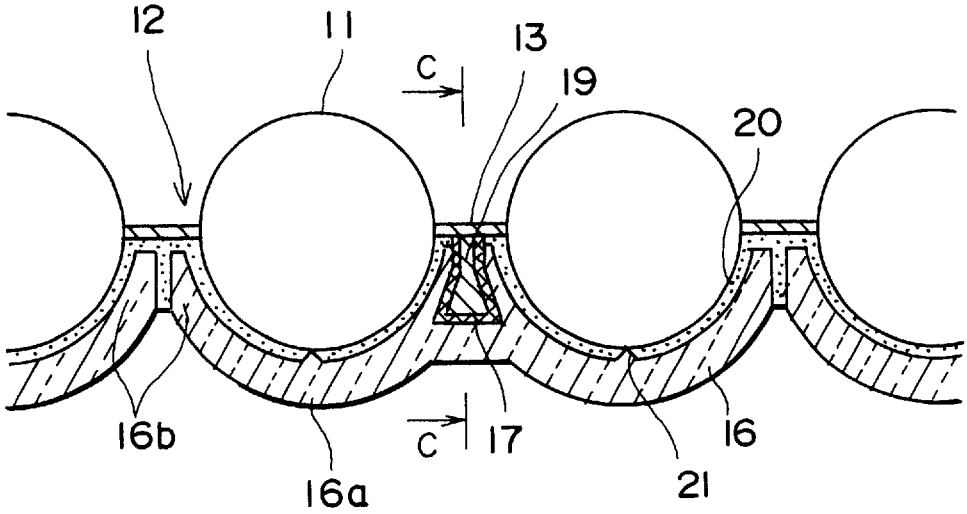
Figure 4:
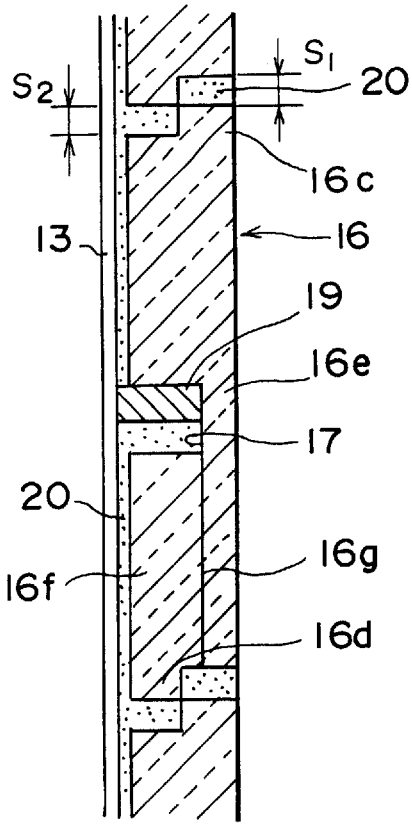
FIG. 4 is a cross section taken along line C—C in FIG. 3.

FIGS. 3 and 4 show a second preferred embodiment of this invention.

In these figures, flat rib 13 on the boiler tube assembly 12 has an arm 19 projecting from it. The cross-sectional area of this arm increases along the axis along which it extends at a specified pitch from the rib toward heat-resistant block 16. It would also be acceptable for the cross-sectional area of the arm 19 to increase abruptly at a given point along its axis of projection toward block 16. The block 16 has an indentation 17 opposite the arm 19. The arm 19 engages in this indentation 17 and is held in place by mortar 20.

As can be seen in FIG. 4, the arm 19 and indentation 17 are both oriented horizontally (i.e., they are perpendicular to the surface of rib 13). In this configuration, heat-resistant block 16 is fixed securely to the rib 13 which connects two tubes 11.

All other aspects of the configuration are identical to those of the first embodiment shown in FIGS. 1 and 2. Components which are the same in both embodiments have been given the same reference numerals.

FIGS. 5 through 8 show a third preferred embodiment of this invention.

In these figures, 18 is an arm which projects from rib 13 on tube assembly 12. Just as in the first embodiment pictured in FIGS. 1 and 2, arm 18 consists of a projection 18*b*, which extends from the rib 13 at a right angle with respect to the surface of the rib, and a vertical portion 18*a*, which is bent upward at a 90° angle from the projection 18*b*.

17 is the indentation in heat-resistant block 16. Just as in the first embodiment discussed earlier, the arm 18 is shaped so that it can engage in this indentation.

Figure 5:
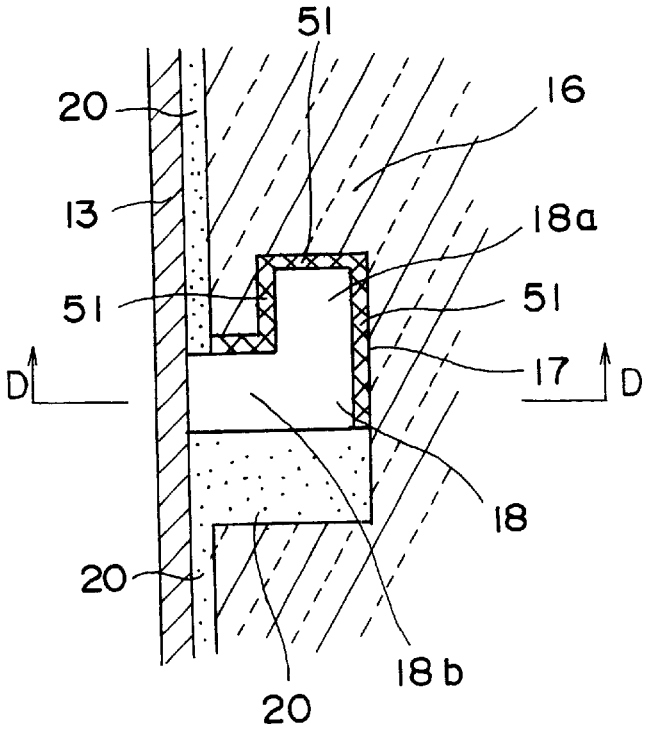
FIG. 5 shows a preferred embodiment corresponding to claim 7 of this application. This drawing corresponds to the cross section taken along line B—B in FIG. 1.
Figure 6:
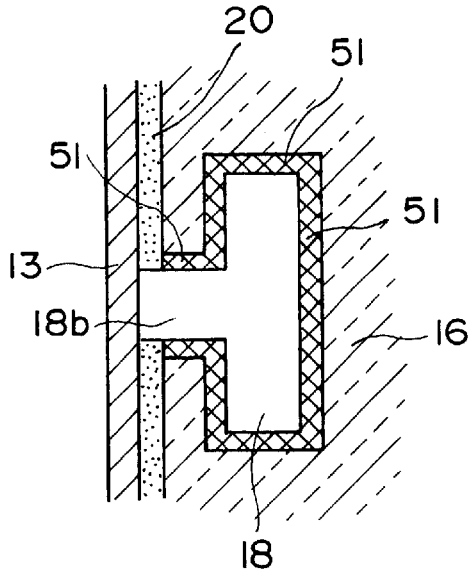
FIG. 6 is a cross section taken along line D—D in FIG. 5.

In this embodiment, as can be seen in FIGS. 5 and 6, the space between mainly the vertical portion 18a of arm 18 and the surface of indentation 17 in heat-resistant block 16 is filled with a fusible substance 51.

Fusible substance 51 consists of a material which will melt if the temperature of the arm 18 reaches 250° C. Preferably, rubber tape can be used which melts at 250° C., or the surface of arm 18 can be coated with a paint which melts at the same temperature.

Mortar 20 is introduced into all crevices which are not filled by the fusible substance 51.

Figure 7:
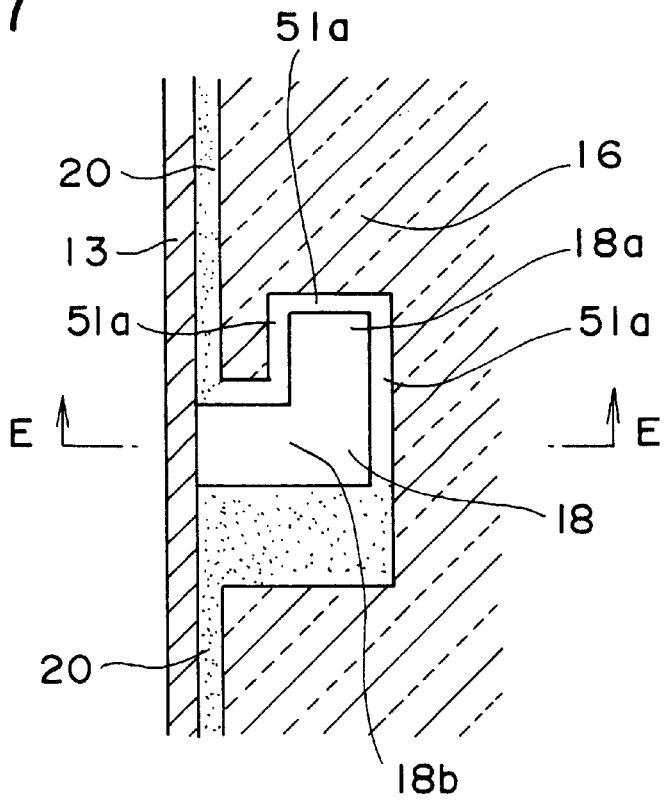
FIG. 7 illustrates the use of the invention disclosed in claim 7 of this application. It is a cross section corresponding to FIG. 5.
Figure 8:
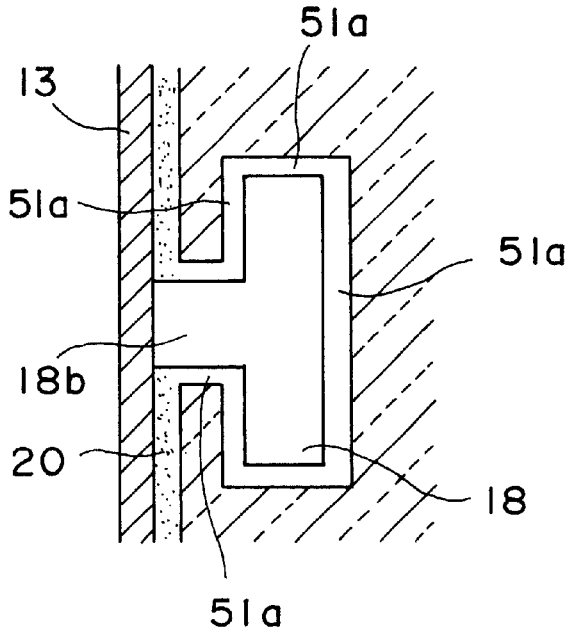
FIG. 8 is a cross section taken along line E—E in FIG. 7.

In this third embodiment, if the temperature of arm 18 of tube assembly 12 rises to 250° C., during operation, the heat transmitted by arm 18 will cause the fusible substance 51 to melt, as is shown in FIGS. 7 and 8. This will create a gap 51*a* between the surface of arm 18 and the surface of indentation 17. As can be seen in the drawings, this gap 51*a* extends around the contour of arm 18.

The gap 51*a* provides a space to accommodate the thermal expansion of the heated arm 18. It absorbs the differential thermal expansion of the arm 18 and block 16, and it prevents damage to mortar 20 caused by this differential expansion in prior art designs.

All other aspects of the configuration are identical to those of the first embodiment shown in FIGS. 1 and 2. Identical components have been given the same reference numerals.

Figure 9:
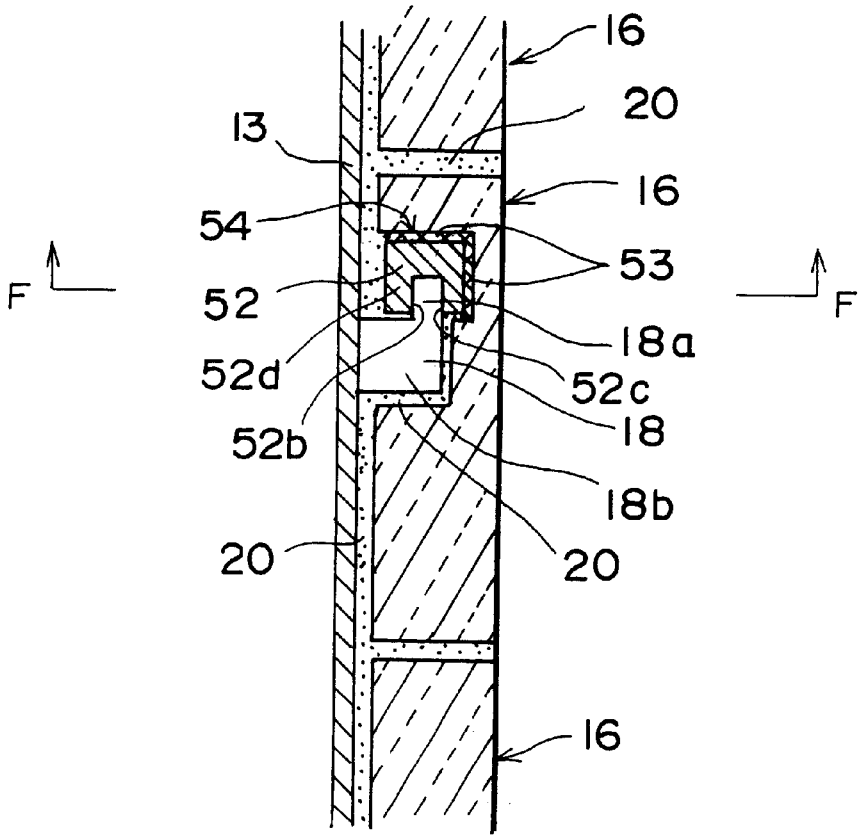
FIG. 9 shows a preferred embodiment corresponding to claims 8 and 9 of this application. This drawing corresponds to the cross section taken along line B—B in FIG. 1.
Figure 10:
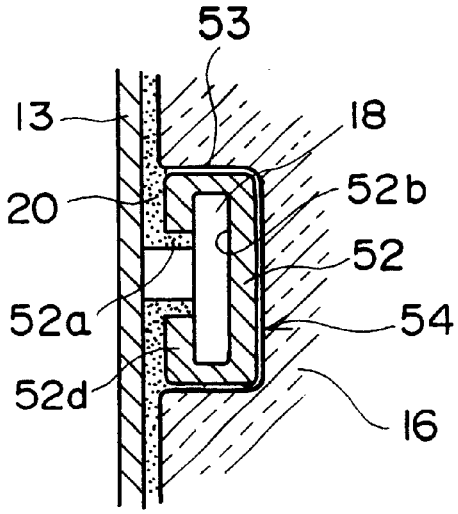
FIG. 10 is a cross section taken along line F—F in FIG. 9.
Figure 11:
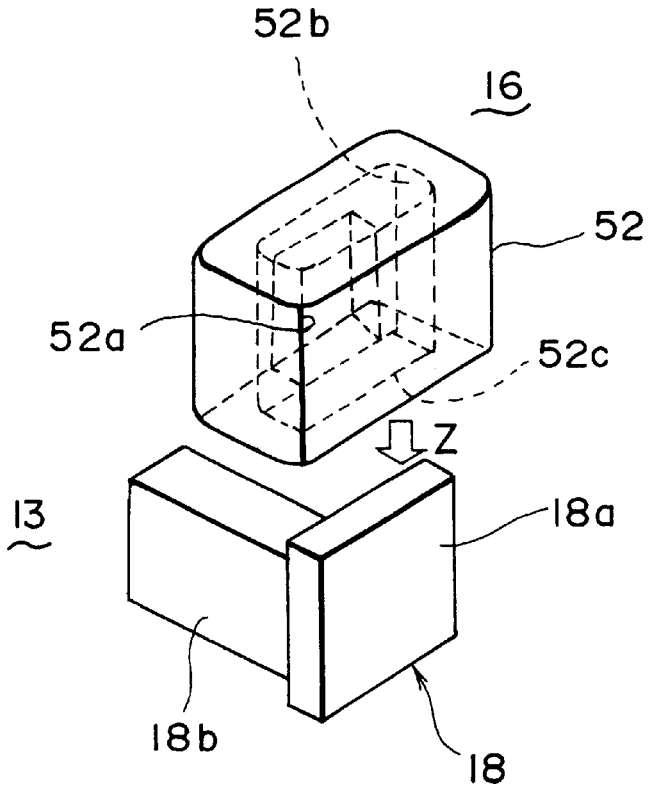
FIG. 11 is a perspective drawing illustrating the use of the embodiment corresponding to claims 8 and 9 of this application.
Figure 12:
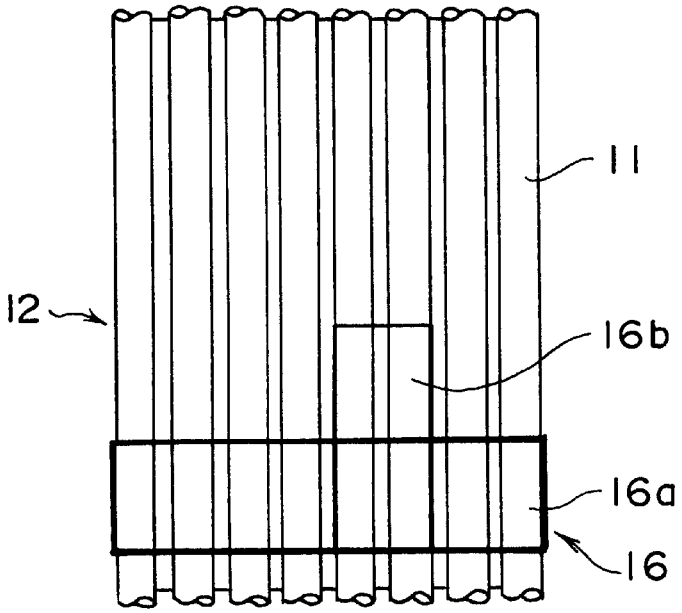
FIG. 12 is a rear view illustrating the method of building the heat-resistant block which is a preferred embodiment corresponding to claims 10 through 12 of this application.

FIGS. 9 through 11 show a fourth preferred embodiment of this invention.

In these figures, 13 is the rib of tube assembly 12, and 18 is the arm which projects from the rib 13. It consists of perpendicular segment 18*b* and upward-pointing segment 18*a*, which results when the end of the arm is bent 90° upward, The configuration of the rib 13 and arm 18 are identical to that of the first embodiment shown in FIGS. 1 and 2.

52 is the heat-resistant sleeve. Sleeve 52 is composed of a heat-resistant material such as silicon carbide which is identical to the material of the heat-resistant block 16. As shown in FIGS. 9 through 11, on the inside of the sleeve 52, on its lower side, that is, the side that arm 18 and rib 13 are on, there is a hollow area 52*b* . This hollow area has two apertures, 52*c* and 52*a*. The arm 18 fits into hollow area 52*b* .

The heat-resistant block 16 has an indentation 54 on the side which faces tube assembly 12. The heat-resistant sleeve 52 fits into this indentation 54.

The outer surface of the sleeve 52 is coated with high-temperature adhesive 53, which maintains ample adhesive strength at high temperatures, and adhered into indentation 54 in block 16.

The adhesive used as the high-temperature adhesive 53 should be one whose adhesive strength is not affected at temperatures in excess of 250° C., such as phosphoric acid mortar or Allonceramic.

In the embodiment described immediately above, which is pictured in FIGS. 9 and 10, heat-resistant block 16 is mounted to tube assembly 12 as follows. Sleeve 52 is inserted into indentation 54 on the side of block 16 which faces rib 13 from that side. Its outer surface is coated with high-temperature adhesive 53 and it is adhered to the surface of indentation 54 in block 16.

Next, as can be seen in FIG. 11, the upward-pointing portion 18*a* of arm 18 is inserted into aperture 52*c* on the bottom of sleeve 52, which is now fixed to block 16 by adhesive 53. Block 16 and sleeve 52 are lowered onto the arm, and portion 18*a* engages in chamber 52*b* of sleeve 52.

Since sleeve 52 has an aperture 52*a* on the side facing rib 13, arm 18 can engage smoothly in chamber 52*b* .

After the arm engages in the sleeve, as can be seen in FIGS. 9 and 10, projection 52*d* on the inner side of the sleeve prevents portion 18*a* of arm 18 from moving toward rib 13. Arm 18 and sleeve 52 are interlocked together securely with no possibility the arm will be displaced or dislodged.

As has been discussed above, once arm 18 engages in heat-resistant sleeve 52, mortar is introduced into the spaces around block 16.

With this embodiment, then, no locking mechanism for arm 18 is formed in indentation 54 of heat-resistant block 16. Rather, the indentation is simply a smooth-sided opening which faces rib 13. Block 16 can easily be removed from the mold when it is pressed, which allows it to be manufactured by press-molding.

Next, the construction process used to assemble the heat-resistant assembly for protecting boiler tubes will be explained with reference to FIGS. 12 through 18.

(1) First, to attach heat-resistant block 16 to tube assembly 12, which includes tubes 11 (See FIG. 12), the lowest row of segments, 16*a*, is fixed to tube assembly 12. Next, the second row from the bottom, 16*b*, is attached. Subsequent rows are added until the tops of the tubes are reached.

(2) After every third or fourth block, an expansion gauge is mounted along the path traversed by the heat in tubes 11. These gauges are installed so that thermal expansion can be accommodated.

(3) As can be seen in FIGS. 13 and 14, mortar 20 is introduced onto the tops of ribs 13 between tubes 11. The mortar 20, as will be explained shortly, is finished to the specified thickness $t_1$, (approximately 10 mm) using scraper 55.

The scraper 55, as can be seen in FIGS. 13 and 14, has curved portions 55*a* on its edge which correspond to the contours of the tubes 11. Between the curved portions 55*a* is a flat portion 55*b*, which allows mortar 20 to be finished to the specified thickness $t_1$ (10 mm).

After mortar 20 has been introduced into the spaces between tube assembly 12 and block 16 as described above, the rounded portions 55*a* of scraper 55 are brought into contact with the surfaces of tubes 11. Using these surfaces as a guide, scraper 55 is moved along the length of tubes 11 as indicated by the arrows in FIG. 14.

This action causes the flat portion 55*b* of scraper 55 to remove any excess mortar 20 so that the mortar can be finished to the proper thickness $t_1$.

(4) Next, as can be seen in FIGS. 15 and 16, mortar 20 is provided onto rounded surfaces 16n of the heat-resistant block 16.

The mortar 20, as will be explained shortly, is finished to a specified thickness $t_2$ (approximately 5 mm) using scraper 56.

The scraper 56, which can be seen in FIGS. 15 and 16, has two convex surfaces 56*b*, which are of the same diameter as the surface of the tubes 11. The two convex surfaces 56*b* are connected by a flat surface 56*a*.

The relative dimensions of the flat surface 56*a* and convex surface 56*b* are chosen so that when flat surface 56*a* of the scraper 56 comes in contact with flat surface 16m of block 16, the mortar 20 between convex surfaces 56*b* and concave surfaces 16*n* of block 16 will be scraped to the specified thickness $t_2$ (5 mm).

When mortar 20 has been disposed on concave surface 16*n* of heat-resistant block 16, flat surface 56*a* of scraper 56 is brought into contact with flat surface 16*m* of block 16. Using the surface 16*m* as a guide, scraper 56 is moved along the length of tubes 11 as indicated by the arrows in FIG. 16.

This action causes the convex surface 56*b* of scraper 56 to remove any excess mortar 20 so that the mortar can be finished to the proper thickness $t_2$.

(5) Next, as can be seen in FIG. 17, the heat-resistant block 16 to which mortar 20 has been applied is pushed toward rib 13 and at the same time pulled downward along the longitudinal axis of tube assembly 12 in order to hang the block on arm 18, which protrudes from rib 13.

(6) As can be seen in FIG. 18, the back surface of block 16 is pounded with plastic hammer 58. This causes the block 16 to be securely attached to tube assembly 12 by mortar 20.

The pounding of block 16 with the hammer 58 should begin in the center of the block and proceed to the top and bottom and then the left and right sides.

As has been described above, once block 16 is attached to tube assembly 12, the thickness of mortar 20 is measured by gauge 57 to verify that it is the specified thickness $t_3$. Effects of the Invention As discussed above, the present invention achieves the following effects. The heat-resistant block is interlocked to the tube assembly by being hung, picture-fashion, from above, taking advantage of the weight of the block. To hang the block, the indentation in its surface is placed over the arm on the rib of the tube assembly. Thus, even if the tube assembly is covered, the heat-resistant block can be fastened to it easily and securely in such a way that it can be removed and reinstalled. Segments of the block can be securely attached anywhere on the tubes in such a way that they are removable.

Since each segment of the block can be installed or removed independently, any portion of the block can easily be repaired, with the result that the block is easier to maintain.

The block is removably attached to the tube assembly by fitting the arm on the tube assembly into the indentation in the block without the use of mounting hardware such as nuts and bolts. Thus there is no thermal constraint between the tube assembly and the block. Temperature differentials, drops in temperature and thermal stress attributable to variation in the thickness of the block are mitigated.

As has been discussed, no nuts or other fastening hardware is needed, so there are no components which protrude into the chamber where they will be exposed to high-temperature combustion gases. This prevents the block from experiencing high-temperature corrosion.

This design allows a heat-resistant assembly with superior durability to be achieved.

In particular, with the invention disclosed in claim 7 of this application, if a high temperature is attained during operation, the fusible substance interposed between the arm and the indentation in the block will melt to create a gap to accommodate the thermal expansion of the arm. This prevents the mortar from being damaged by the arm and the mortar having different rates of thermal expansion.

With the inventions disclosed in claims 10 through 12 of this application, the process of introducing the mortar is divided into two steps: applying the mortar to the tube assembly, and applying the mortar to the block. Since the mortar is applied to an exposed space, the process does not require any particular skill, and the mortar can be finished to the prescribed thickness using a gauge such as a scraper.

Since the areas to be filled with mortar on both the tube assembly and the block are depressed, they can be scraped using the protruding surfaces (i.e., the peripheral surfaces of the tubes and the flat surface of the block opposite the rib) as a guide.

The excess mortar applied between the tube assembly and the block is scraped off with a scraper whose working edge has two concavities, using the surfaces of the tubes and the flat portion of the block as a guide. This makes it easy to remove the excess mortar and reduces the number of assembly processes required. The mortar is finished to the proper thickness, which prevents any variation in its strength as well as the effects these would have on the service life of the block.

What is claimed is:

1. A heat-resistant assembly for releasably attaching a heat-resistant block to a boiler tube assembly comprised of a plurality of boiler tubes and a connecting flat rib, with said heat resistant block positioned between the boiler tube assembly and combustion gases in order to protect the boiler tube assembly from the combustion gases, said heat resistant assembly comprising:

an arm which protrudes from said connecting flat rib toward said heat-resistant block and which has a catch on the end;

an indentation in said heat-resistant block into which said catch on said arm interlockingly engages; and at least one member disposed between the end of the arm and the indentation through which the arm engages the indentation, said at least one member being selected from the group consisting of a buffer member which absorbs thermal expansion and melts at high temperature, and a heat resistant member which enhances the strength of the engagement.

2. A heat-resistant assembly for protecting a boiler tube assembly according to claim 1, wherein said at least one member is a buffer member which absorbs thermal expansion and which comprises a coating.

3. A heat-resistant assembly according to claim 1, wherein said at least one member is a buffer member comprising a fusible substance provided in a space between the end of said arm and said indentation of said block, said fusible substance melting when the temperature of said arm exceeds a given value.

4. A heat-resistant assembly for protecting a boiler tube assembly according to claim 1, comprising:

said arm which protrudes from said connecting flat rib toward said heat-resistant block and which has the catch on the end;

said indentation provided in said heat-resistant block at the side of said connecting flat rib; and said heat resistant member as a heat resistant sleeve adhered in said indentation by an adhesive agent;

said catch on said arm interlockingly engaging said sleeve to releasably attach the heat-resistant block to the boiler tubes.

5. A heat-resistant assembly according to claim 4, wherein said heat resistant sleeve is made of silicon carbide.

6. A heat-resistant assembly according to claim 4, wherein said sleeve is made of a heat-resistant silica-containing material of the same family as said heat-resistant block, and said adhesive agent is a high-temperature resistant adhesive.

7. A heat-resistant assembly according to claim 1, wherein said catch on said arm is formed by bending the end of said arm which protrudes toward said block so that said catch is angled vertically parallel to said boiler tubes.

8. A heat-resistant assembly according to claim 1, wherein said arm has a cross section configured to have thermal expansion increase from the tube assembly side towards the heat-resistant block side.

9. A heat-resistant assembly according to claim 8, wherein a cross section through the catch on said arm nearer said heat-resistant block has a greater area than a cross section nearer said tube assembly, and said indentation is provided on said block to interlockingly engage said catch in order to attach the heat-resistant block to the boiler tubes.

10. A heat-resistant assembly according to claim 9, wherein said catch on said arm is formed by bending the end of said arm which projects toward said block so as to be angled vertically parallel to said tube assembly, and the block is caused by gravity to descend so that said vertical catch can interlockingly engage in said indentation.

11. A heat-resistant assembly according to claim 9, wherein a cross section through said catch on said arm nearer said heat-resistant block has a greater area than a cross section through said arm nearer said tube assembly, and said indentation is provided on said block to interlockingly engage with said catch in order to attach said heat-resistant block to said boiler tube assembly.

12. A heat-resistant assembly according to claim 1, wherein the heat resistant block has marginal projections which may overlap with projections of adjacent heat resistant blocks, wherein the projection at one side of the block faces the combustion gases and the projection at the other side of the block faces the tube assembly.

* * * * *